United States Patent [19]

Furgal

[11] 4,053,992

[45] Oct. 18, 1977

[54] APPARATUS AND METHOD FOR CONDITIONING FIBROUS MATERIALS, UTILIZING AND ABRADABLE CONDITIONING AGENT FASTENED TO THE INTERIOR OF AN AUTOMATIC LAUNDRY DRYER DOOR

[75] Inventor: Henry P. Furgal, Bernardsville, N.J.

[73] Assignee: Colgate-Palmolive Company, New York, N.Y.

[21] Appl. No.: 337,353

[22] Filed: Mar. 2, 1973

Related U.S. Application Data

[63] Continuation of Ser. No. 82,235, Oct. 20, 1970, abandoned.

[51] Int. Cl.[2] ..... F26B 19/00

[52] U.S. Cl. ..... 34/60; 118/58; 118/418; 427/242

[58] Field of Search ..... 34/12, 60, 133; 117/109, 118; 118/76, 77, 78, 417, 418; 427/242

[56] References Cited

U.S. PATENT DOCUMENTS

| | | | |
|---|---|---|---|
| 199,504 | 1/1878 | Bray | 117/109 |
| 2,846,776 | 8/1958 | Clark | 34/133 |
| 3,435,537 | 4/1969 | Rumsey | 34/72 |
| 3,442,692 | 5/1969 | Gaiser | 117/120 |
| 3,554,784 | 1/1971 | Lyness | 117/139.5 X |
| 3,634,947 | 1/1972 | Furgal | 34/60 |
| 3,972,131 | 8/1976 | Rudy et al. | 34/60 |

*Primary Examiner*—Kenneth W. Sprague
*Assistant Examiner*—James C. Yeung
*Attorney, Agent, or Firm*—Herbert S. Sylvester; Murray M. Grill; Norman Blumenkopf

[57] ABSTRACT

An apparatus for conditioning fibrous materials includes an automatic laundry dryer, usually of the substantially horizontally rotating tumbling drum type, having a substantially vertical door which closes the drum, which door has fastened to the inside thereof a conditioning article from which conditioning agent is removable on contact with the tumbling fibrous materials and becomes deposited on them. Also disclosed is a method of conditioning fibrous materials in such an apparatus.

3 Claims, 7 Drawing Figures

APPARATUS AND METHOD FOR CONDITIONING FIBROUS MATERIALS, UTILIZING AND ABRADABLE CONDITIONING AGENT FASTENED TO THE INTERIOR OF AN AUTOMATIC LAUNDRY DRYER DOOR

This is a continuation of application Ser. No. 82,235, filed Oct. 20, 1970, abandoned.

SUBJECT OF THE INVENTION

This invention relates to the conditioning of fibrous materials, such as laundry, in an automatic laundry dryer or similar machine, wherein the conditioning agent is mounted on or held to a closure or door on the machine. The conditioning agent is preferably a fabric softener and/or antistatic agent and is deposited on the fabrics to be conditioned by contact with such fabrics as they tumble past the machine closure.

BACKGROUND OF THE INVENTION

Various devices and compositions have been employed to condition fibers, fabrics and laundry. Such conditioning may be effected with any of various suitable agents to improve a wide variety of properties of the materials treated. Generally, the most important conditioning effected is softening, especially with respect to cottons which have been laundered in aqueous solutions of heavy duty synthetic organic detergents. Also, and of increasing importance with the growing use of synthetic fabrics, treatment of such fabrics and laundry incorporating them has been desirable to diminish objectionable tendencies of such materials to become electrostatically charged, whereby they cling together or adhere closely and objectionably to various other surfaces. Of course, other conditioning may also be effected, such as making the treated articles antibacterial, soil-repellant, antifungal, perfumed, brightened, sized or lubricated. With respect to the various above treatments, especially with respect to softening fabrics and making them antistatic, the principal mechanisms employed in the past have relied on the substantivity of the treating material to the fabrics being treated. Thus, a treating chemical, dissolved in the last rinse, becomes tightly held by the fabric and is not removed after discharge of the rinse water and subsequent drying. Recently, such softening and/or antistatic agents have been applied to materials in conjunction with the drying operation. Thus, in U.S. Pat. No. 3,442,692, it is taught that various cationic conditioning agents can be used to impregnate flexible substrate materials, such as paper, cloth or sponge, and can be vaporized from these as they are tumbled during a drying operation, so that they may be sorbed by the moving laundry present in the dryer. Other researchers in the laboratories of the assignee of the present application have discovered various other compositions, articles, apparatuses and methods for treating fabrics and laundry in an automatic laundry dryer or similar machine and effecting improved conditioning thereof. Some of those improvements have been described in patent applications on such subjects which are so assigned and are filed on the same day as the present application.

Although such methods represent important improvements in the softening of laundry, utilizing a drying step which is employed anyway, the present apparatus and method represent further advances in this art, whereby good softening is obtained and the softening articles are very easy to use, requiring a minimum of effort on the part of the housewife and thereby greatly improving their consumer acceptances.

DESCRIPTION OF THE INVENTION

In accordance with the present invention, an apparatus for conditioning fibrous materials comprises an automatic laundry dryer door or front having fastened to the inside thereof in form-retaining relationship therewith and in such position as to be contacted by tumbling fibrous materials to be conditioned, a conditioning article from which conditioning agent is removable on contact with the fibrous materials, so that it is deposited on the fibers and conditions the materials. In preferred forms of the invention, the dryer is of the substantially horizontally rotating tumbling drum type and the door is substantially vertical and stationary during conditioning. Also, the conditioning article comprises a base which is held stationary with respect to the dryer door and the conditioning agent removed from the base and deposited upon the fabrics being treated is a synthetic organic surface active softener and/or antistatic agent. Also within the invention is a method of conditioning fibrous materials by tumbling them into contact with such a conditioning article held to the dryer door. In such operations the laundry being treated is preferably damp laundry which has just been washed and the dryer operates at an elevated temperature for a suitable period of time, generally from 3 minutes to 2 hours.

Various details, constructions, operations, uses and advantages of the invention will be apparent from the following description, taken in conjunction with the illustrative drawing of some embodiments thereof, in which drawing:

THE DRAWING

DETAILED DESCRIPTION OF THE INVENTION

Figure 1:
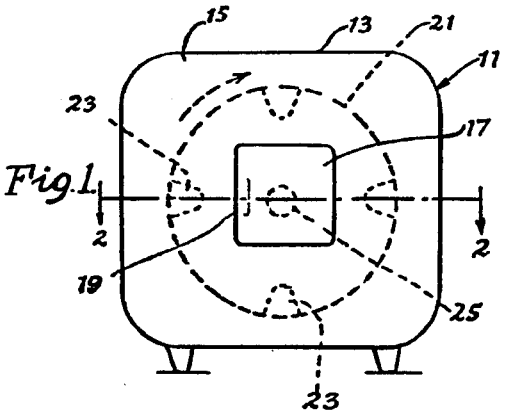
FIG. 1 is a front elevation of an automatic laundry dryer, showing the attachment of a conditioning article to the interior of the door thereof.

As is illustrated in FIG. 1, a commercial automatic laundry dryer 11 of either the gas or electric type has a body or shell portion 13 in which there is on the front thereof 15 a hinged door 17 having a handle 19. Inside the dryer body is a substantially horizontally positioned substantially cylindrical drum 21, which rotates about a horizontal axis. The drum fits with the front of the dryer to form an enclosure, closed by door 17, in which enclosure damp laundry to be dried is placed. The drum rotates in the direction of the arrow and flights 23 thereon lift the laundry as the drum rotates and thereby circulate it inside the dryer, allowing it to come into good contact with heated drying air which is blown through the drum and a lint trap, not illustrated, and out through an exhaust pipe. As the laundry tumbles in the dryer and falls down from an upper section to which it is carried by flights 23, it rubs against a centrally positioned hemispherically shaped conditioning article 25 which comprises a polystyrene foam base covered on the curved surface thereof with a coating of conditioning agent which, under the conditions of operations of the dryer, is removable from the base and depositable on the materials to be conditioned. Usually the conditioning material is a softener and/or anti-static agent which is normally solid but under the conditions of the dryer becomes soft enough to be removable from the substrate.

Figure 2:
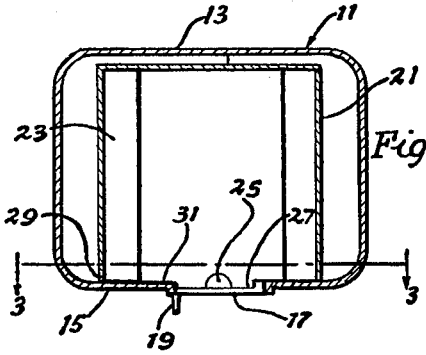
FIG. 2 is a horizontal section of such dryer, along plane 2—2 of FIG. 1.
Figure 3:
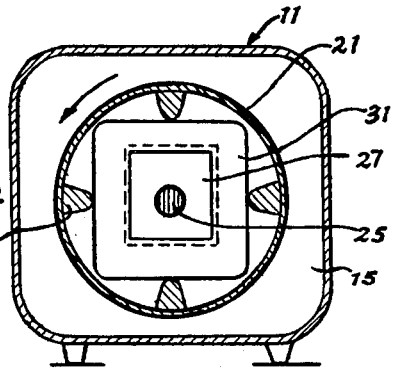
FIG. 3 is a vertical section along plane 3—3 of FIG. 2, showing the conditioning article affixed to the door interior.

In FIG. 2, another view of the apparatus of FIG. 1, the closure of the dryer door 17 against front wall portion 15 is more clearly illustrated. As will be noted, the conditioning article 25 is substantially centrally located on the door interior 27. Also shown is the seal of the front portion 29 of rotating drum 21 against the interior 31 of the front 15 of dryer 11. FIG. 3 also shows the detail of the closure of the dryer drum.

Figure 4:
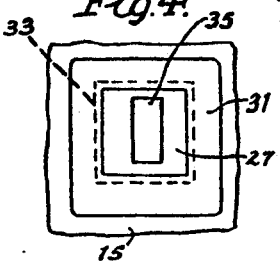
FIG. 4 is a partial elevational view corresponding to FIG. 3 but illustrating a different conditioning article.
Figure 5:
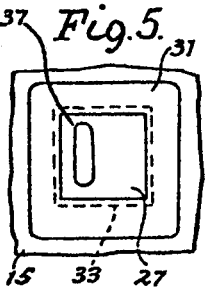
FIG. 5 is another such partial elevational view showing another conditioning article in place.
Figure 6:
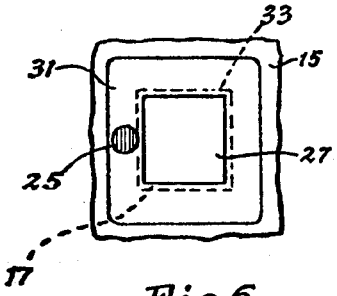
FIG. 6 is another such view, showing the conditioning article affixed to a portion of the front of the dryer adjacent to the door.
Figure 7:
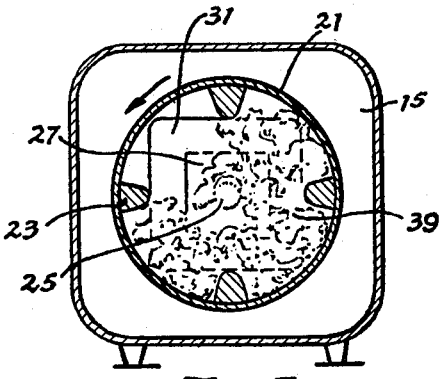
FIG. 7 is a view corresponding to FIG. 3 but showing the laundry inside the dryer in tumbling contact with the conditioning article.

In FIG. 4 there is illustrated the use of a flat flexible material such as paper, cloth or sponge, coated with conditioning agent and centrally positioned on the dryer door. The outline of the door is indicated by numeral 33 and the conditioning article is identified by numeral 35. In FIG. 5 the conditioning article is a vertically positioned half cylinder 37 of paperboard having rounded ends and coated with conditioning agent. As will be noted, it is located to a side of the center of the door, that side being the one where downward movement of the laundry occurs. In FIG. 6 is shown a hemispherical conditioning article 25 positioned on the inside area 31 of the front of the dryer, adjacent to the door 17. In FIG. 7 a view similar to that of FIG. 3 is given, showing the laundry 39 and its position due to lifting effects of the flights and the direction of rotation of the dryer drum.

The automatic laundry dryer or equivalent machine employed in accordance with the present invention is any of the well known commercial or industrial types of such machines. Generally, these are gas or electric dryers which contain a drum which rotates about a substantially horizontal axis and which has openings therein for the passage of drying air through the drum and through the contained laundry which is being dried. The fronts of such machines will usually include an outwardly and sidewardly or downwardly swinging door which is substantially vertical and closes the substantially cylindrical dryer drum to prevent laundry from being discharged from it unless the door is opened. Dryers of this type usually have drums of a diameter between 0.5 to 1.5 meters, with the home laundry dryers usually having a diameter from 0.7 to 1 meter. The generally cylindrical form of the dryer drum may be modified by being rounded or tapered at various portions thereof and will usually contain internal baffles, flights or other projections to aid in satisfactorily tumbling the laundry being treated. The material of construction of the dryer drum and door will normally be porcelainized or enamelled metal but plastics, reinforced plastics, special glasses or ceramics or other suitable materials of construction may also be used. It will often be preferred to have the dryer door contain a transparent portion of synthetic organic polymeric plastic material or glass so as to allow the user to view the laundry and the conditioning ariticle employed in the dryer in accordance with this invention.

In most operations means will be provided to supply air to the drying drum and to exhaust it with contained moisture removed from the laundry. Also, means for heating the air will generally be used. The air flow rate will usually be such that from 5 to 50 changes of dryer gas will be made per minute. The gas temperature will be from 10° to 90° C., preferably from 50° to 90° C. and more preferably from 60° to 80° C. Yet, in some instances, tumbling may be effected without air flow and without heating.

Because the dryer door is located at one end of the tumbling drum and the drum has an appreciable length, usually being from 0.2 to 1.5 meters and more often from 0.3 to 0.5 meter, it is clear that most of the tumbling laundry or fabrics to be conditioned will not be in frequent contact with the dryer door or material affixed to it. Yet, despite this lack of contact and the expectation that conditioning material applied to the tumbling laundry from a location adjacent the front of the dryer or the door would be ineffective, it has been found that good conditioning is obtainable by such means and that the method and apparatus possess special advantages not otherwise obtained. For example, the article for applying conditioning agent to the materials to be treated may be positioned easily, without undue strain, which might otherwise be required to fasten it to a more "interior" part of the dryer. During use, the dryer may be halted, usually merely by opening the door, and the extent of consumption of conditioning material may be observed. If there should be any weakening of the hold of the conditioning article to the dryer front or door this can be readily observed by opening the door. Special illumination is not required nor does the laundry have to be removed from contact with the conditioning article, since it usually falls away from the article upon halting of the dryer, especially if the laundry is still damp, in which condition spotting or staining is possible. In such manner stains due to too long a contact of the conditioning article with the materials being treated are avoided. Should any mechanical tightening of the holding device be needed, this may be easily effected when the conditioning article is fastened to the door but would be more difficult to carry out on an inner part of the dryer. The degree of consumption of conditioning material, especially in those cases wherein the material is abraded from the surface of a conditioning article, is more readily regulated when the conditioning article is positioned on the dryer door or front. Thus, by raising or lowering such position or by lengthening or shortening the conditioning article so that it projects more or less into the body of the tumbling drum, the conditioning rate may be increased or decreased. Additionally, in those cases where the substrate for the conditioning material is not form-retaining, it may be made so, diminishing the possibilities of cracking off of the conditioning composition, by being fastened to the form retaining and generally planar dryer door. Furthermore, because of the stationary positioning of the conditioning article, and the falling of laundry from a high point to which it is carried by tumbling of the drum, to the bottom thereof past the conditioning article, the contacts of the laundry with the conditioning composition are fleeting ones of brief duration, thereby leading to a lower likelihood of any staining of fabrics being conditioned, due to too long a contact with the conditioning agent or accompanying materials. Compared to tumbling conditioning articles the present apparatus also possesses advantages. Various densities of substrates can be used without fear of floating on top the laundry or not being sufficiently heavy to cause abrasions of conditioning agent. Also, noises of contacts of conditioning articles with dryer walls are prevented when the article is held stationary on the dryer door.

The conditioning articles employed require no moving parts and usually comprise a form-retaining substrate, on the exterior of which is deposited a conditioning composition in such position as to be removable under the dryer conditions by contact with fabrics to be conditioned as they tumble in the dryer drum. Although form-retaining bases or substrates are preferred, flexible substrates may also be used but to minimize cracking and flaking off of conditioning composition or conditioning agent such are normally held to the dryer front or door in such manner as to become essentially form-retaining. Of course many advantages of the invention are also obtainable when a form-retaining, flexible or resilient base is mobile, although held to the dryer door. Generally, the conditioning composition is in a solid form, capable of being softened or partially dissolved at the conditions of operation of the dryer, high humidity and relatively high temperature. Nevertheless, dispensers which contain liquids that are removable therefrom by contact with fabrics or laundry to be treated may also be used. Normally, all such dispensers will project no further into the interior of the rotating laundry drum than 15 cm. and it is preferred that they extend no farther than 10 cm., with most of the best embodiments of the invention extending no farther than about 8 cm. This is to minimize entangling of laundry with the conditioning article and to prevent the article from serving as a hanger for materials being treated. In this respect, although generally no moving parts are present, it may sometimes be desirable to have a rotatable portion of the article, such as a rotatable sleeve or sphere on a shaft extending into the dryer from the door to aid in the release from the conditioning article of any material being treated that may become hung thereon. Usually, such a moving part will be kept close to the dryer door, preferably not extending more than three inches into the dryer from the door interior, to minimize tangling of wash on it and to prevent release of the article during tumbling.

The various forms of conditioning article which may be employed are numerous, including form-retaining bases or containers, such as polystyrene or polyurethane foam hemispheres, slabs, half-cylinders, parallelepipeds, paraboloids or other shapes, preferably rounded, or flexible materials, such as paper, cloth, sponge, rubber, or plastic strips or sheets. The form-retaining bases may be made of any suitable material of construction, such as wood, paperboard, synthetic organic polymeric plastic, metal, heat-resistant glass or minerals. The plastics employed may often be used as hollow members or may be foams. Usually, a surface-deposited conditioning agent will penetrate only slightly below the exterior of such bases. Instead of employing normally solid conditioning agents, solutions of such materials or other conditioning compounds may be used. The conditioning compositions may have various adjuvant materials, solvents, release agents, plasticizers or other conditioning compounds present with them. Generally, the conditioning compound will comprise a major proportion of the conditioning composition except in those cases where liquids are used, when the proportion of active material may be as little as 0.1%.

The fastening of the conditioning article to the dryer door or front may be by any well known means for accomplishing such a purpose, including screws, cements, hooks, clamps, spring loaded members, slots, cavities or other equivalent or similar means, providing only that such a device will not interfere with the tumbling of the materials being treated and will satisfactorily hold the conditioning article under actual use conditions.

The primary types of conditioning agents employed are fabric softeners, antistatic agents and anti-wrinkling materials. The softeners are especially useful with respect to cotton fabrics and the antistatic agents are highly desirable in the treatment of synthetic materials or those containing some synthetic polymeric fibers. Other conditioning agents may also be used, including perfumes, brighteners, bleaches, germicides, sizes and water repellent compounds. The amounts of such materials or compositions containing them that are employed will be sufficient to effect the conditioning of the charge of laundry or other materials in the tumbling drum. Thus, the concentration of conditioning agent, the thickness of an external deposit on a substrate or the amount of liquid material used will be chosen to be sufficient to effect conditioning of at least the entire charge. In some cases, extra material may be present and the conditioning article may be used to treat a subsequent charge.

Of the fabric softeners, antistatic agents and antiwrinkling compounds, although it is preferred to utilize the nonstaining anionic and nonionic materials, which become satisfactorily soft or plastic at the conditions of dryer operations, cationic compounds and mixtures of nonionics with eitheer anionics or cationics may also be employed. Exemplary of the materials that may be used are tallow alcohol sulfate, preferably as the sodium salt, stearic monoethanolamide, nonyl phenoxy polyalkoxy ethanol, block copolymers of ethylene oxide and propylene oxide (Pluronics®), higher fatty acid soaps, benzethonium halides, higher fatty alkyl amines and quaternary ammonium halides, e. g., di-tallow alkyl dimethyl ammonium chloride. Various other such surface active conditioning agents are described in patent applications entitled FABRIC CONDITIONING METHODS, ARTICLES AND COMPOSITIONS (G. T. Hewitt and A. S. Wilson); and FABRIC CONDITIONING ARTICLE AND USE THEREOF (G. T. Hewitt and A. S. Wilson). Other conditioning compositions are disclosed in an application on APPARATUS, ARTICLE, PACKAGE AND METHOD FOR CONDITIONING FIBROUS MATERIALS WITH LIQUID CONDITIONING COMPOSITION (H. P. Furgal). Such applications are being filed on the same day as the present case. Accordingly, lengthy descriptions of the various conditioning agents and their applications to substrates or formulation in solutions will not be given here.

The present articles are simple to apply to the dryer door and are easy to use. The treating methods are effective for conditioning fabrics and special care on the part of the user is unnecessary. The conditioning article is positioned or held in place on the automatic dryer or tumbling device door and a drying or treating operation is commenced. The location on the door may be selected so as to effect a rapid or slower conditioning, since position on the door and mode of attachment influence the rate of transfer of conditioning composition to the materials being treated. In some instances, instead of being positioned on the inside of the dryer door, an equivalent portion of the dryer wall adjacent to the door may be the site of application of the conditioning article. However, such a site does not have all the advantages of the dryer door interior which were mentioned previously.

Operation of the dryer drum is started with a load of damp laundry or other materials to be treated and the laundry and conditioning article are in relative movement, with a combination of heat, moisture and abrading action due to contact causing the release of conditioning agent from the external surface of the conditioning article and its deposit on the fabrics being treated. In other cases, a melt or liquid conditioning agent will be dispensed from the held article onto the fabrics coming into contact with it.

Although it is preferred to use an automatic laundry dryer, equivalent machines may be employed, and in some instances, heat and drying air may be omitted for part or all of the cycle. Generally however, air will be employed and will be circulated frequently. Normally there will be about five to 50 changes of drying gas in the dryer drum per minute and the gas temperature will be from 10° to 90° C., preferably from 50° to 80° C. or 90° C. The dryer will usually revolve at about 20 to 100 revolutions per minute, preferably 40 to 80 r.p.m. The weight of laundry employed will usually be from 4 to 12 pounds, preferably from 5 to 10 pounds, dry weight. This will fill 10 to 70% of the volume of the dryer, when damp, and preferably this will be from 30 to 60% thereof. Accordingly, sufficient room will be present for free falling of the laundry past the conditioning article. Drying will usually take from 5 minutes to 2 hours and generally from 20 minutes to 1 hour will be sufficient, with synthetic fabrics, such as nylon, polyesters and synthetic-natural blends requiring somewhat shorter periods of time than cotton laundry. Synthetics may often be dried satisfactorily in 3 to 10 minutes and resin-treated fabrics of the permanently pressed and non-wrinkling type may be dried in from 10 minutes to ½ hour.

After completion of the conditioning operation and the drying of the laundry, the conditioning article is examined. If sufficient softener remains, the article may be left in place and employed again until complete removal of the conditioning agent. If the laundry is not satisfactorily conditioned, additional tumbling thereof may be in order, either with the conditioning article previously employed or another such article. To obtain different levels of conditioning activities or different effects, there may be used several treating articles or a plurality of different articles, located at various places on the interior of the dryer door. Of course, after the conditioning agent has been consumed it may be replaced by another such article for future use. If the conditioning composition employed is a coating on a base, the base may be re-coated. If a liquid is used, the dispenser may be re-filled. If desired, the previous substrate or container may be discarded and a new one may be employed.

Other details about uses of the present and related compositions, articles and methods may be found in the patent applications previously referred to and therefore, great detail will not be given here.

The following examples illustrate several embodiments of the invention. Unless otherwise indicated, all parts are by weight, temperatures are in degrees Centigrade and the measurements are in the metric system. The examples and illustrations given herein are not intended to limit the scope of the invention because it is evident that various modifications may be made and equivalents may be substituted without departing from the spirit thereof.

EXAMPLE 1

A melt of 70 parts of stearic monoethanolamide and 30 parts of stearic diethanolamide is prepared by heating a mixture of the amides to a temperature of about 90° C., while continuing mixing to maintain uniformity. The melt is brushed onto a hemisphere of commercial polystyrene foam from which rough edges have been removed by a sanding operation. The flat surface of the hemisphere is not coated with the conditioner composition. Application of the ethanolamide mixture is over the entire curved surface of the 15 centimeter diameter hemisphere to a thickness of 0.03 cm. above the surface and about 0.01 cm. below it or into the interstices thereof. Thus about 10 to 15 grams of usable conditioner are avialable for application to fabrics to be softened.

After solidification of the conditioning agent on the polystryrene foam base, the conditioning article is fastened to the inner surface of a dryer door on a conventional electric automatic laundry dryer of the type illustrated in the figures, with the point of affixation being that shown in FIGS. 1–3. This is approximately in the upper middle of the door so that damp laundry, as loaded into the dryer, will normally be below the conditioning article and out of contact with it. Fastening is effected by application of rubber cement to the door and the article and applying the article to the door after the cement becomes tacky, due to partial evaporation of solvent. In other experiments, instead of using rubber cement, other cements, such as epoxy resins, cellulose acetates, proteinaceous animal glues and phenolic resins are employed. Instead of cementing, fastening may also be effected by fusion, pressure-sensitive tapes, or by conventional fastening devices such as clamps, screws, ties, slots into which the conditioning article fits tightly, etc.

After application of the conditioning article to the dryer door, the damp laundry is added while the door is open, and operation of the dryer is commenced. The laundry treated is a mixture of wearing apparel and household articles, totaling eight pounds, about 3.6 kilograms, and includes cottons, synthetic fiber fabrics, especially polyesters, polyacetates and blends of these polymeric plastics with each other or with cotton, nylons, rayons and resin-treated, permanently pressed and wrinkle resistant fabrics. The wash comprises approximately 50% of cotton articles, 20% of polyester-cotton blends, 10% permanently pressed items, 10% nylon articles and the balance of rayon, acetate, etc. The laundry to be conditioned occupies 40% of the dryer volume and the drying air is blown through the dryer at the rate of about 200 cubic feet per minute, at an initial temperature of about 70° C. The drum rotates at about a speed of 60 r.p.m. Initially the temperature of the damp laundry is low, approximately 20° C., but as drying continues, it increases to almost 70° C. The conditioning agent on the surface of the hemisphere is abraded from it onto the surface of the fabrics being treated so that when, after 50 minutes of drying, the machine is turned off and the laundry is removed, it is found to be static-free, sweet smelling and soft to the touch, compared to a similar load in which the conditioning article is not used. The removal of conditioning agent from the hemisphere is fairly uniform over the surface thereof although more appears to be removed from the top than from the bottom, apparently due to more frequent contacts of tumbling laundry with the top portion of the conditioning article. Clothing treated is not spotted or stained by the conditioning agent and periodic examination of the conditioning article during the operation of the dryer shows that the coating is held satisfactorily to the polystyrene foam base. There is no flaking or cracking of the conditioning composition evident. On examination of the hemisphere after use it is found that approximately three grams of conditioning composition have been abraded from the surface onto the fabrics to be treated. Since this amount is sufficient for good conditioning, in those cases where the drying cycle and the conditioning of laundry is such that more material is not needed, the conditioning article may be removed during the drying cycle at a particular time at which it is determinable that approximately three grams have been deposited upon the materials to be conditioned. Subsequently, the article may be re-used with another load of laundry. Of course, effort should be made to remove any cement from the inside of the door before resuming drying, to prevent it from being deposited on the laundry.

In other drying runs, using the same conditioning article and automatic laundry dryer, certain readily dried articles are removed earlier than the end of the drying operation. For example, those made from nylon are removed after five minutes and permanently pressed articles are withdrawn after 15 minutes and both are found to be satisfactorily conditioned, being soft, static-free and wrinkle-free.

In other tests, instead of employing the formula described above, there is used a melt of lauric monoethanolamide and stearic diethanolamide, also in 70:30 proportion, and comparable results are obtained. Similarly, when an alcoholic solution of distearly dimethyl ammonium chloride, preferably with the distearyl being obtained from hydrogenated tallow alcohol, is employed to coat the same substrate at approximately the same weight of conditioning composition per unit area and the conditioning procedure is repeated, good softening of cotton and antistatic action on synthetic organic polymeric textiles are obtained. The conditioning solution employed comprises 55% distearly dimethyl ammonium chloride, 30% ethanol and 15% water and the solvents are evaporated off after application.

When synthetic organic anionic surface active agents, such as sodium lauryl sulfate and soap are used and are applied in the same quantities, either as melts or solutions to substrates of the type described, they are also satisfactory for conditioning of test laundry. It may also be observed that additions of plasticizing agents, release agents and other conditioning agents, such as perfumes, brighteners, bleaches, etc., are helpful and the use of the plasticizer aids in improving even further the non-cracking and non-flaking characteristics of the conditioning agents, so as to insure prevention of any spotting or staining of treated materials.

When the above experiments are repeated, using other deposits of the mentioned conditioning agents, so that more or less thereof is employed and when the areas of the surfaces of the substrates are modified, good conditioning is also obtained provided that sufficient available conditioning agent is present on the surface of the conditioning article to be abraded from it and transferred to the materials to be treated. Thus, when the exposed area of the conditioning article is within the range of 5 to 3,000 sq. cm. and the depth of application of conditioning agent on that surface is from 0.001 to 0.5 cm., with the weight/area being from 0.001 to 0.5 g./sq. cm., for dryer loads of weights within the range of 2 to 5 kg., satisfactory softening and antistatic activities are obtained.

EXAMPLE 2

When instead of the polystyrene sphere of Example 1, a hollow half cylinder having a length of 20 cm. and a diameter of 10 cm., with rounded ends, is used, with the same types of coatings and to the same depths, as illustrated in FIG. 5, good conditioning is obtained whether the axis of the cylinder is vertical, horizontal or intermediate. Such conditioning is effected whether the cylinder is made from polystyrene foam, paperboard, wood or other synthetic organic polymeric plastic materials other than polystyrene. Similarly, when a strip of flexible paper is used, such as is illustrated in FIG. 4, and is fastened to the interior of the dryer door, good conditioning results provided that at least three grams of conditioning agent are available for transfer from the paper. Generally, the area of the paper should be from 100 to 250 sq. cm. and the depth of coating agent is from 0.02 to 0.1 cm. Such good results are also obtained when the conditioning article is fastened to the stationary interior portion of the front of the dryer which communicates with the rotating drum, although affixation at such a position has no advantages over fastening to the door and is not nearly as convenient.

To obtain different degrees of conditioning or the same degree of conditioning at different rates, the location of the conditioning article is moved about on the dryer door with particular types of dryer loads or different weights thereof, so as to obtain the most desired conditioning effects.

EXAMPLE 3

Instead of employing the most preferred coated substrate conditioning article, when a dilute solution of conditioning agent is used and allowed to drip out of a hollow container at a desired rate, upon contact thereof with the laundry being conditioned satisfactory softening and antistatic effects are observed. Thus, when 200 c. cm. of a 0.2% solution of dimethyl distearyl ammonium chloride in water is allowed to seep out of a hollow hemispherical container of similar volume into contact with tumbling laundry, the laundry becomes soft, unwrinkled and static-free. Similar results are obtained using other solutions or emulsions of the previously mentioned conditioning agents. The dispensing device and suitable formulas are described in the relevant previously mentioned co-filed patent application of the present invention.

What is claimed is:

1. An apparatus for softening laundry which comprises an automatic laundry dryer of a substantially horizontally rotating tumbling drum type, having a door at the front thereof which is substantially vertical and stationary during rotation of the drum, with said door having fastened to the inside thereof in form-retaining relationship therewith in such position as to be contactable by tumbling laundry to be softened, a conditioning article comprising a hemisphere base of a polymer means to adhesively secure said base to the dryer door and a conditioning agent coating external to the base and abradably removable therefrom on contact with tumbling laundry to be conditioned during drying of such materials in the automatic laundry dryer, said conditioning agent being selected from the group consisting of synthetic organic surface active anionic, nonionic, cationic, anionic-nonionic and cationic-nonionic fabric softeners and being held in form-retaining relationship with the base said coating being characterized such that about 3 grams thereof per 8 lb. load of laundry are abraided from the surface of the coating unto the fabrics during the drying of the tumbling laundry.

2. An apparatus according to claim 1 including means to circulate heated air through the dryer and means to heat the air to a temperature of 50° to 90° C. and with the conditioning article positioned on the interior of the dryer door to a side thereof, in which position it is contactable by the moving laundry.

3. An apparatus according to claim 1 wherein the hemisphere is polystyrene foam.

* * * * *